US005921279A

United States Patent [19]

Barber

[11] Patent Number: 5,921,279

[45] Date of Patent: Jul. 13, 1999

[54] SOLENOID OPERATED DUAL SPOOL CONTROL VALVE

[75] Inventor: Dennis R. Barber, Oconomowoc, Wis.

[73] Assignee: HUSCO International, Inc., Waukesha, Wis.

[21] Appl. No.: 09/069,513

[22] Filed: Apr. 29, 1998

[51] Int. Cl.[6] ..... F15B 13/043

[52] U.S. Cl. ..... 137/596.16; 91/455; 91/464

[58] Field of Search ..... 91/455, 464; 137/596.16

[56] References Cited

U.S. PATENT DOCUMENTS

| | | | |
|---|---|---|---|
| 3,587,640 | 6/1971 | Hanser | 137/596.14 |
| 3,924,656 | 12/1975 | Hanser et al. | 91/464 X |
| 4,201,116 | 5/1980 | Martin | 91/387 |
| 4,741,364 | 5/1988 | Stoss et al. | 137/625.64 |
| 4,875,501 | 10/1989 | Ichihashi et al. | 137/625.64 |
| 5,242,149 | 9/1993 | Sikkema | 251/129.07 |
| 5,350,152 | 9/1994 | Hutchison et al. | 251/30.05 |
| 5,568,759 | 10/1996 | Aardema | 91/461 |
| 5,664,477 | 9/1997 | Koehler | 137/596.16 X |

*Primary Examiner*—Gerald A. Michalsky
*Attorney, Agent, or Firm*—Quarles & Brady LLP

[57] ABSTRACT

A proportional hydraulic control valve assembly has a pair of bores in a valve body with separate control spools in each bore. A pair of force feedback, linear actuators are mounted on the same side of the valve body and each actuator controls the movement of a different one of the control spools. Only one of the control spools governs application of hydraulic power to a first work port of the valve assembly, while connecting a second work port to tank. Only the other control spool governs application of hydraulic power to the second work port of the valve assembly, while connecting a first work port to tank. The force feedback, linear actuators enable each spool to be received very tightly within the respective bore.

17 Claims, 2 Drawing Sheets

SOLENOID OPERATED DUAL SPOOL CONTROL VALVE

BACKGROUND OF THE INVENTION

The present invention relates to solenoid operated control valves for hydraulic systems, and more particularly to such valves of a force-feedback type.

Construction and agricultural equipment have moveable members which are operated by a hydraulic cylinder and piston combination. The cylinder is divided into two internal chambers by the piston and alternate application of hydraulic fluid under pressure to each chamber moves the piston in opposite directions.

Application of hydraulic fluid to the cylinder typically is controlled by a manually operated valve, such as the one described in U.S. Pat. No. 5,579,642. In this type of valve, a manual lever was mechanically connected to a spool within a bore of the valve. A human equipment operator moves the lever to place the spool into various positions with respect to cavities in the bore that communicate with a pump outlet, a fluid reservoir or the cylinder. Moving the spool in one direction controls the flow of pressurized hydraulic fluid from the pump to one of the cylinder chambers and the fluid flow from the other chamber to the reservoir. Moving the spool in the opposite direction reverses the application and draining of fluid with respect to the cylinder chambers. By varying the degree to which the spool is moved in the appropriate direction, the rate at which fluid flows into the associated cylinder chamber can be varied, thereby moving the piston at proportionally different speeds.

In addition, some control valves provide a "float" position in which both cylinder chambers are connected simultaneously via the spool to the fluid reservoir. This position allows the member driven by the cylinder to move freely in response to external forces. For example, a snow plow blade may be allowed to float against the pavement to accommodate variations in surface contour and avoid digging into the pavement.

There is a trend with respect to construction and agricultural equipment away from manually operated hydraulic valves toward electrically controlled solenoid valves. This type of system simplifies the hydraulic plumbing as the control valves can be located near the cylinder and not in the operator cab. This change in technology also facilitates computerized regulation of various machine functions.

Solenoid valves are well known for controlling the flow of hydraulic fluid and employ an electromagnetic coil which moves an armature in one direction to open a valve. Either the armature or a valve member is spring loaded to close the valve when electric current is removed from the coil.

In order to actuate a standard bidirectional spool valve with a solenoid mechanism, a separate solenoid actuator had to be connected to each end of the spool. This significantly increased the overall length of the valve assembly which was disadvantageous in some installations. In addition, this configuration requires a control circuit that prevents both solenoid actuators from being energized simultaneously and working against each other.

As an alternative, hydraulic systems have been devised which utilize a pair of solenoid valves for each cylinder chamber to be power driven. For a given cylinder chamber, one solenoid valve controls the application of fluid under pressure from a pump to move the piston in one direction, and the other solenoid valve is alternatively opened to drain fluid from the given chamber to a tank to move the piston in the opposite direction. If both chambers of a cylinder are to be power driven, four such solenoid valves are required, two supply valves and two drain valves.

SUMMARY OF THE INVENTION

A general object of the present invention is to provide a solenoid operated valve assembly for controlling the flow of hydraulic fluid to and from a pair of cylinder chambers.

Another object is to provide a solenoid operated valve assembly which proportionally controls the flow of hydraulic fluid.

Another object is to provide a solenoid operated spool valve.

A further object of the present invention is to utilize only two solenoid operators in such spool valve assembly.

Yet another object is to provide a compact solenoid operated valve assembly.

Another aspect of the present invention is to provide a solenoid operated spool valve assembly with a float position.

A proportional hydraulic control valve has a valve body with a first bore and a second bore therein, and a first work port, a second work port, a supply port and a tank port all of which communicate with both of the first and second bores. The first work port is for connecting one chamber of the cylinder to the valve and the second work port is for connection of the other cylinder chamber.

A first control slidably received in the first bore and has a plurality of grooves separated by land sections. The first control spool has a first position along the first bore at which one of the plurality of grooves defines a fluid path between the first work port and the supply port, and at which another one of the plurality of grooves defines a fluid path between the second work port and the tank port. In a second position along the first bore, the land sections of the first control spool close communication between the first work port and the supply port, and communication between the second work port and the tank port.

A second control spool is accommodated in the second bore for axial sliding movement therein, and has a plurality of grooves separated by land sections. The second control spool has a first position along the second bore at which one of the plurality of grooves defines a fluid path between the second work port and the supply port, and at which another one of the plurality of grooves defines a fluid path between the first work port and the tank port. The second control spool has a second position along the second bore at which the land sections close communication between the first work port and the tank port and between the second work port and the supply port.

A first linear actuator is located within the first bore and produces movement of the first control spool within the first bore. A second linear actuator is within the second bore and produces movement of the second control spool within the second bore. Preferably the first and second linear actuators are mounted on the same side of the valve body to minimize the overall size of the apparatus. In the preferred embodiment the first and second linear actuators are of the force feed back type and a particular design for these components is described herein.

The present construction of the proportional hydraulic control valve utilizes only the first spool to control application of hydraulic power to one work port, while only the other spool controls application of hydraulic power to the second work port. By employing force feedback actuators, efficient operation of the system can be achieved even with tight fits between each of the control spools and the respective bore.

DETAILED DESCRIPTION OF THE INVENTION

Figure 1:
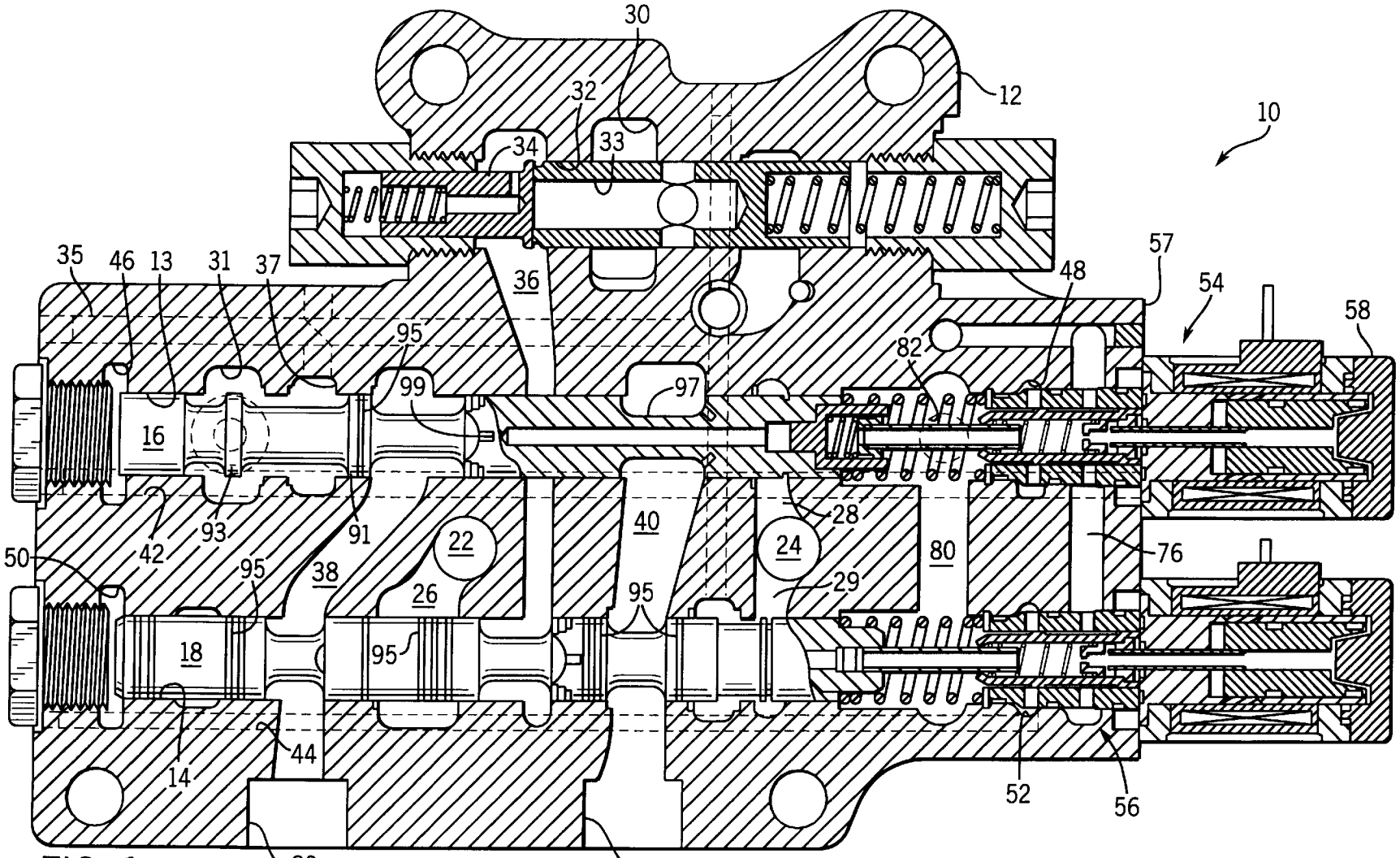
FIG. 1 is a cross sectional view through a solenoid operated valve assembly according to the present invention.

With initial reference to FIG. 1, a control valve assembly 10 comprises a body 12 having first and second bores 13 and 14 extending therethrough. The first bore 13 has a first reciprocal control spool 16 therein and the second bore 14 contains a second reciprocal control spool 18, with both control spools being movable longitudinally within the respective bore to control the flow of hydraulic fluid to a pair of work ports 20 and 21. The first and second work ports 20 and 21 are respectively connected by the first and second work port channels 38 and 40 to each spool bore. Each control spool includes a plurality of axially spaced circumferential grooves located intermediate of lands which cooperate with the respective bore 13 or 14 to control the flow of hydraulic fluid between different cavities and openings into the bores, as will be described. Both control spools 16 and 18 are shown in the neutral position in which fluid is not flowing into or out of the work ports 20 and 21. The valve body 12 preferably is formed of several segments bolted together to provide an interconnection of the various bores, channels and ports.

The valve body 12 has a pair of ports 22 and 24 that are connected together and to the tank of the hydraulic system in which the valve assembly 10 is connected. The first tank port 22 opens into a cavity 26 which extends around the second bore 14. The other tank port 24 communicates with a channel that opens into cavities 28 and 29 which extend around the first and second bores 13 and 14, respectively.

The valve body 12 also has a supply port 30 which is connected to the output of a pump of the hydraulic system. The pump inlet communicates with a third bore 32 within the valve body 12 which has a spool type pressure compensator 33 therein. This compensator 33 is of the same general type as described in U.S. Pat. No. 5,579,642, which description is incorporated herein by reference. The pressure compensator 33 controls the flow of hydraulic fluid from the supply port 30 to a pump channel 36 which extends from the third bore 32 to each of the spool bores 13 and 14. An inlet check valve 34 prevents back-flow in the event of loss of pump pressure. Although the present valve assembly is described in terms of a plurality of supply ports, these passages may connect to a single common external port on the valve body to which the pump is connected or there may be a plurality of external pump connection ports. The same applies to the tank port connection.

Control passages 42 and 44, shown in phantom, extend in the valve body 12 parallel to the spool bores 13 and 14, respectively, beneath the plane of the cross section of FIG. 1. Control passage 42 extends from an annular control cavity 46 at one end of the first bore 13 to a second annular control cavity 48 in the first bore 13 at the opposite end of the control spool 16. Similarly the second control channel 44 extends from a control cavity around the second spool bore 14 at one end of the second control spool 18 to a control cavity 52 at the opposite end of second control spool.

The first bore 13 also has a cavity 31 proximate to the opposite end of the first control spool and that cavity 31 is connected to the tank port by a passage through the valve body 12. An adjacent annular bore cavity 37 is connected to a work port sensing channel 35 which is part of the inlet pressure compensator 33.

Each of the control spools 16 and 18 is coupled to a separate force feedback actuator 54 or 56, respectively, that are mounted on one side 57 of the valve body 12. As shown in detail in FIG. 2, the first force feedback actuator 54 has a solenoid 58 with an electromagnetic coil 60 within which an armature 62 is slidable located inside a guide sleeve 64. The armature 62 is attached by a tube 66 to a tubular pilot valve member which is slidably received within a pilot sleeve 70 located within the first bore 13. The pilot sleeve 70 has a transverse aperture 72 extending between the control cavity 48 and the interior of the sleeve. Another transverse aperture 74 extends through the pilot sleeve 70 in fixed communication with a pilot supply channel 76 which extends between the two spool bores 13 and 14 and a supply passage 78 leading to the supply port for the hydraulic pump. Movement of the pilot valve member 68 in response to the movement of the solenoid armature 62 selectively provides a path between the control cavity 48 and either the pilot supply channel 76 or a tank channel 80. The tank channel 80 is connected via a valve body passageway 82 to the tank port of the valve body.

A feedback tube 84 is slidably received within the pilot valve member 68. A high rate, feedback spring 86 biases the pilot valve member 68 away from one end of the feedback tube 84. The rate of the spring determines the amount of main spool travel per unit of solenoid force. The other end of the feedback tube 84 has a flange 88 which is captivated within a cavity of a coupling 90 secured to the proximate end of first control spool 16. A low rate float spring 92 biases the feedback tube flange 88 away from the first control spool 16 and against a snap ring 94 in an interior groove of the spool coupling 90. The float spring 92 is preloaded so that it is inactive during normal metering. A high rate load spring 96 biases the end of the first control spool 16 away from the pilot valve sleeve 70 and hence away from the side 57 of the valve body 12. The relative rates of the feedback and float springs 86 and 92 allow fine control during metering and a transition into float with little additional solenoid force.

The second force feedback actuator 56 has a construction which is similar to that of the first force feedback actuator 54. The primary difference is that the feedback tube 98 for the second force feedback actuator 56 is fixedly coupled to the end of the second control spool 18 and does not have the spring loaded coupling 90 and its associated components for the first control spool 16. Those additional components of the first force feedback actuator 54 are provided to enable float operation which will be described.

Figure 2:
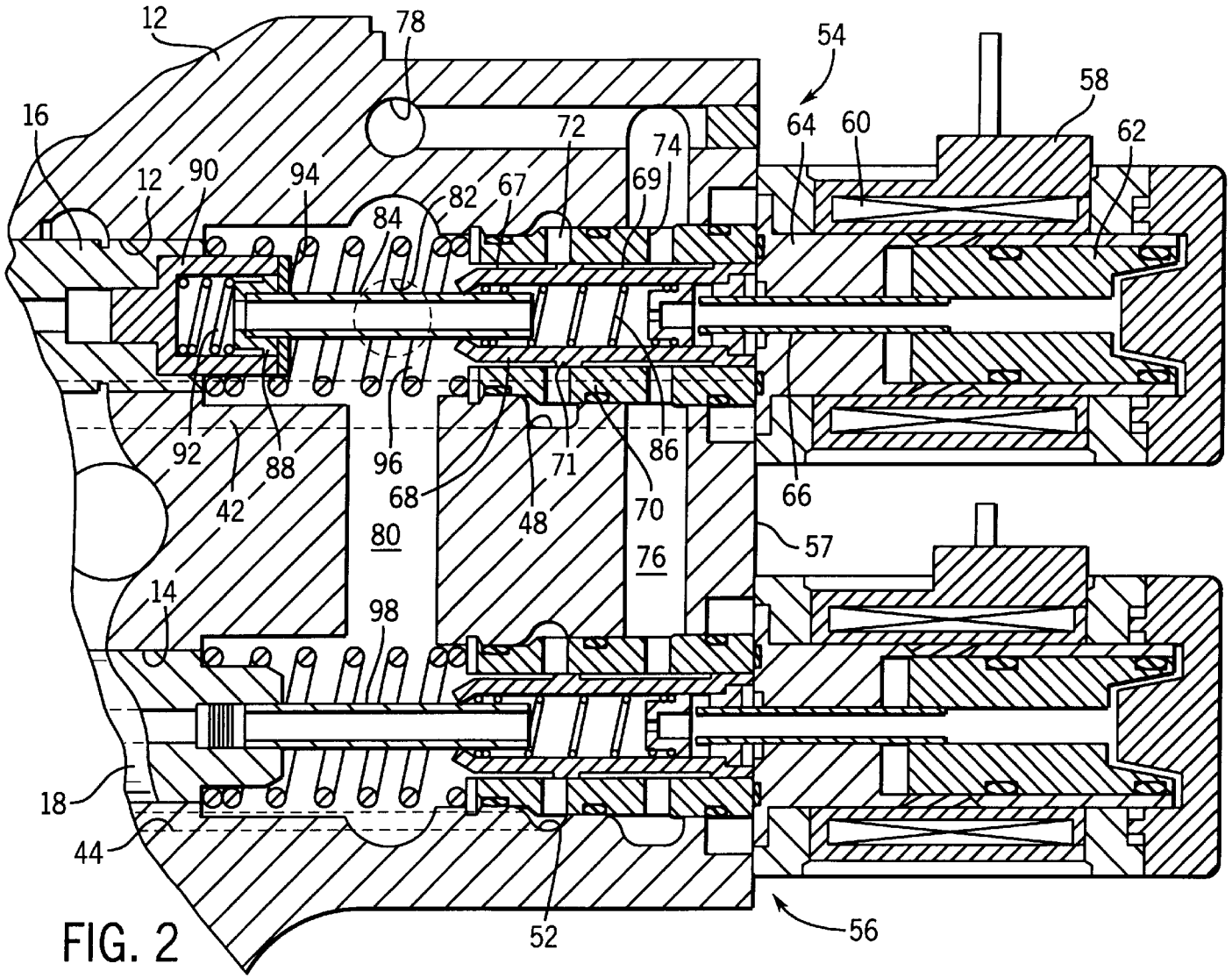
FIG. 2 is an enlarged view of the solenoid pilot valve actuators in the valve assembly.

With reference to both FIGS. 1 and 2, in order to apply fluid from the pump to the first work port 20, the solenoid 58 of the first force feedback actuator 54 is energized. This generates a magnetic field which moves the armature 62 leftward in the drawings thereby producing movement of the pilot valve member 68 in the same direction. As a result, a groove 69 on the outer surface of the pilot valve member 68 now provides a passage between the pilot supply channel 76 and the control cavity 48. This communicates the pump pressure in the pilot supply channel 76 via the control passage 42 to another control cavity 46 at the remote end of the first control spool 16. The magnitude of the electric current through the solenoid 58 determines the size of the pilot valve passage and thus the amount of pressure exerted on the remote end of the first control spool 16.

The pump pressure acting on the remote end of the first control spool 16 moves that spool to the right in FIG. 1 and compresses the relatively high rate feedback spring 86. Movement of the first control spool 16 aligns a metering orifice 99 with the pump channel 36 allowing fluid from the hydraulic pump to flow through channel 38 to the first work port 20. The greater the distance that the first control spool 16 moves to the right, the larger the metering orifice becomes and the greater the flow of fluid to the first work port 20. At the same time, another groove 97 of the first control spool 16 moves into communication between the second work port 21 and the tank cavity 28, thereby allowing fluid to drain from the second work port to the tank of the hydraulic system.

This movement of the first control spool 16 compresses the load spring 96 and causes the feedback tube to compress the feedback spring 86 which acts on the pilot valve member. When the feedback force from the first control spool 16 slightly exceeds the force of the solenoid 58, the pilot valve member 68 moves to the right in the drawing until its land 71 closes the transverse aperture 72 in the pilot sleeve 70 which leads to the control passage 42. This closure of the control passage stops further movement on the control spool 16 and establishes a flow rate out of the first work port 20 that corresponds to the magnitude of electric current which is driving the first solenoid 58.

It should be noted that the pilot valve member 68 remains in the open position until the first control spool moves sufficiently to force the pilot valve member into the closed state. This action is relatively unaffected by the magnitude of friction between the first control spool 16 and the first bore 13. The greater the friction, the greater the pilot valve opening and the greater the pressure through the control passage 42 to move the first control spool 16. Thus a relatively tight fit can be achieved between the bore and control spool. Even though the friction may change over time, the operation of the control spool remains the same. This main spool also is unaffected by flow forces which might tend to cause an error in the desired spool position.

The valve assembly 10 is returned to the neutral position by de-energizing the first force feedback actuator 54. When this occurs, the magnetic force previously exerted on the armature 62 is removed causing the feedback spring 86 to push the pilot valve member 68 farther to the right in FIG. 2. This aligns a relief passage 67 in the outer surface of the pilot valve member 68 with the control passage 42, thereby allowing the fluid within the control passage to drain into the tank channel 80. Thus pressure in control cavity 46 at the remote end of the first spool bore 13 is relieved resulting in the force of load spring 96 moving the first control spool 16 to the left most position illustrated in FIG. 1. In that position, communication between the first work port 20 and the pump channel 36 is closed, as well as communication between the second work port 21 and the tank cavity 28.

To apply the pump pressure to the second work port 21 and couple the first work port 20 to tank, the second force feedback actuator 56 is energized. This actuator operates, in a similar manner to previously described with respect to the first force feedback actuator 54, to move the second control spool 18 to the right. Such movement of the second control spool 18 connects the tank cavity 26 with the channel 38 for the first work port 20 and connects the pump supply channel 36 with the channel 40 for the second work port through a metering orifice.

As noted previously, there are certain applications in which it is desirable to allow the mechanical member being hydraulically operated to float. Such float is achieved by simultaneously connecting both of the work ports 20 and 21, which connects both chambers of the cylinder to tank. However, the present valve assembly 10 has been designed so that proper activation of the first force feedback actuator 54 will move the first control spool 16 into a position in which both of the work ports 20 and 21 are connected to tank passages.

As described previously, energizing the first force feedback actuator 54 moves the first control spool 16 into a position where the metering orifice 99 provides a passage between the pump supply channel 36 and the first work port channel 38. In this position, the groove 97 of the first control spool 16 also provides communication between the second work port channel 40 and the tank cavity 28. That passage reaches maximum size before the solenoid 58 is fully energized and thus before the pilot valve member 68 moves to a position of maximum communication between the pilot supply channel 76 and the control passage 42.

By increasing the magnitude of electric current to the first force feedback actuator 54 beyond that necessary to fully open the flow of fluid from the pump to the first work port 20, the pilot valve member 68 opens further enlarging the passage between the pilot supply channel 76 and the control passage 42. This applies a greater pressure to the control cavity 46 thereby pushing that first control spool 16 farther to the right in the drawings, compressing the low rate float spring 92. With the low rate float spring in series with the feedback spring, the effective rate is relatively low. This low rate results in a large spool movement with a small addition of solenoid force. Thus, the majority of the force range of the solenoid is used for metering and is not wasted to energize float which does not require fluid control. The first control spool 16 assumes a position in which land 91 moves entirely across the first work port channel 38 closing communication between that work port channel and the pump supply channel 36. However, in this position spool land 93 moves into bore cavity 37 opening a passage between the first work port channel 38 and the tank cavity 31 allowing the fluid from the first work port 20 to drain to tank. At the same time, spool groove 97 continues to provide a passage from the second work port channel 40 to the tank cavity 28 so that fluid from the second work port 21 can drain to the tank. Thus both of the work ports 20 and 21 in this state are connected to tank which produces a float of the mechanical element being controlled. The present design utilizes the normal metering range of the first force feedback actuator 54 and first control spool 16 to control the flow of hydraulic fluid from the pump to the first work port 20. A small incremental solenoid force beyond the top of that metering range forces the first control spool 16 into the float position. Thus the control range of the first solenoid 58 is utilized fully for metering the flow of hydraulic fluid from the pump to the first work port 20 where optimal control is needed. The float feature is an unmetered on/off function. The second control spool 18 is not utilized for the float function.

I claim:

1. A proportional hydraulic control valve comprising:

a valve body with a first bore and a second bore therein, and a first work port, a second work port, a supply port and a tank port all of which communicate with both of the first and second bores;

a first control spool accommodated in the first bore for axial sliding movement therein, and having a plurality of grooves separated by land sections, the first control spool having a first position along the first bore at which one of the plurality of grooves defines a fluid path between the first work port and the supply port and at which another one of the plurality of grooves defines a fluid path between the second work port and the tank port, and the first control spool having a second position along the first bore at which the land sections close communication between the first work port and the supply port and between the second work port and the tank port;

a second control spool accommodated in the second bore for axial sliding movement therein, and having a plurality of grooves separated by land sections, the second control spool having a first position along the second bore at which one of the plurality of grooves defines a fluid path between the second work port and the supply port and at which another one of the plurality of grooves defines a fluid path between the first work port and the tank port, and the second control spool having a second position along the second bore at which the land sections close communication between the first work port and the tank port and between the second work port and the supply port;

a first linear actuator located within the first bore and producing movement of the first control spool within the first bore; and a second linear actuator located within the second bore and producing movement of the second control spool within the second bore.

2. The proportional hydraulic control valve as recited in claim 1 wherein the valve body has a first side and the first and second bores extend into the valve body; from first and second openings, respectively, in the first side and the first and second linear actuators are mounted on the first side of the valve body.

3. The proportional hydraulic control valve as recited in claim 1 wherein the first and second linear actuators comprise solenoids.

4. The proportional hydraulic control valve as recited in claim 1 wherein the first and second linear actuators are force feedback actuators.

5. The proportional hydraulic control valve as recited in claim 1 wherein the first linear actuator is coupled to one end of the first control spool to receive a first feedback force indicating a position of the first control spool within the first bore; and the second linear actuator is coupled to one end of the second control spool to receive a second feedback force indicating a position of the second control spool within the second bore.

6. The proportional hydraulic control valve as recited in claim 5 wherein:

the first bore has a first control cavity at another end of the first control spool;

the first linear actuator includes a first pilot valve member which selectively controls flow of fluid between the first control cavity and each of the supply and tank ports;

the second bore has a second control cavity at another end of the second control spool; and the second linear actuator includes a second pilot valve member which selectively controls flow of fluid between the second control cavity and each of the supply and tank ports.

7. The proportional hydraulic control valve as recited in claim 6 wherein the first feedback force acts on the first pilot valve member; and the second feedback force acts on the second pilot valve member.

8. The proportional hydraulic control valve as recited in claim 1 wherein the first linear actuator further comprises a mechanism to move the first control spool into a float position in which a fluid passage between the first work port and the tank port is formed along the bore and in which another fluid passage between the second work port and the tank port is formed along the bore.

9. A proportional control hydraulic valve comprising:

a valve body having a first bore and a second bore therein, and a first work port, a second work port, a supply port and a tank port all of which communicate with both of the first and second bores;

a first control spool accommodated in the first bore for axial sliding movement therein, and having a plurality of grooves separated by land sections, the first control spool having a first position along the first bore at which one of the plurality of grooves defines a fluid path between the first work port and the supply port and at which another one of the plurality of grooves defines a fluid path between the second work port and the tank port, and the first control spool having a second position along the first bore at which the land sections close communication between the first work port and the supply port and communication between the second work port and the tank port;

a second control spool accommodated in the second bore for axial sliding movement therein, and having a plurality of grooves separated by land sections, the second control spool having a first position along the second bore at which one of the plurality of grooves defines a fluid path between the second work port and the supply port and at which another one of the plurality of grooves defines a fluid path between the first work port and the tank port, and the second control spool having a second position along the second bore at which the land sections close communication between the first work port and the tank port and communication between the second work port and the supply port;

a first force feedback actuator coupled to one end of the first control spool to move the first control spool axially within the first bore; and a second force feedback actuator coupled to one end of the second control spool to move the second control spool axially within the second bore.

10. The proportional hydraulic control valve as recited in claim 9 wherein the first bore has a first control cavity at another end of the first control spool, the second bore has a second control cavity at another end of the second control spool; and the valve body includes a first control passage extending from the first control cavity to the first force feedback actuator, and has a second control passage extending from the second control cavity to the second force feedback actuator.

11. The proportional hydraulic control valve recited in claim 10 wherein the first force feedback actuator comprises:

a first solenoid having a first armature received within a first electromagnetic coil;

a first pilot valve member within the first bore and coupled to the first armature, the first pilot valve member controlling flow of fluid between the supply port and the first control passage in response to movement of the first armature and in response to a feedback force received from the first control spool.

12. The proportional hydraulic control valve recited in claim 11 wherein the first pilot valve member has a first position which defines a passage through which fluid flows between the supply port and the first control passage, and has position which defines another passage through which fluid flows between the first control passage and the tank port.

13. The proportional hydraulic control valve recited in claim 11 wherein the second force feedback actuator comprises:

a second solenoid having a second armature received within a second electromagnetic coil;

a second pilot valve member within the second bore and coupled to the second armature, the second pilot valve member controlling flow of fluid between the supply port and the second control passage in response to movement of the second control spool.

14. The proportional hydraulic control valve recited in claim 13 wherein the second pilot valve member has a first position which defines a passage through which fluid flows between the supply port and the second control passage, and has second position which defines another passage through which fluid flows between the second control passage and the tank port.

15. The proportional hydraulic control valve recited in claim 9 further comprising a first load spring biasing the one end of the first control spool with respect to the valve body; and a second load spring biasing the one end of the second control spool with respect to the valve body.

16. The proportional hydraulic control valve recited in claim 9 wherein the first control spool has a float position in which a fluid passage between the first work port and the tank port is formed along the bore, and another fluid passage between is formed between the second work port and the tank port along the bore.

17. The proportional hydraulic control valve as recited in claim 9 wherein the valve body has a first side and the first and second bores extend from first and second openings, respectively in the first side into the valve body; and the first and second force feedback actuators are mounted on the first side of the valve body.

* * * * *